United States Patent [19]

Horimoto et al.

[11] 4,318,757

[45] Mar. 9, 1982

[54] PROCESS FOR PRODUCING FERRO-MAGNETIC METAL PARTICLES

[75] Inventors: Rioichi Horimoto, Komoro; Riyuuzou Seike, Saku, both of Japan

[73] Assignee: TDK Electronics Co., Ltd., Tokyo, Japan

[21] Appl. No.: 146,878

[22] Filed: May 5, 1980

[30] Foreign Application Priority Data

May 11, 1979 [JP] Japan ..... 54-58357
May 11, 1979 [JP] Japan ..... 54-58358

[51] Int. Cl.[3] ..... H01F 1/02

[52] U.S. Cl. ..... 148/105; 75/0.5 AA; 75/0.5 BA

[58] Field of Search ..... 148/105; 75/0.5 AA, 75/0.5 B, 0.5 BA, 0.5 C

[56] References Cited

U.S. PATENT DOCUMENTS 3,661,554 5/1972 Wijard et al. ..... 75/3
3,966,454 6/1976 Ito et al. ..... 75/0.5 BA
3,967,986 7/1976 Rau et al. ..... 148/105
3,974,245 8/1976 Cheney et al. ..... 75/0.5 BA
4,213,777 7/1980 Grebe et al. ..... 75/0.5 BA

FOREIGN PATENT DOCUMENTS 317705 1/1972 U.S.S.R. ..... 75/121

*Primary Examiner*—L. Dewayne Rutledge
*Assistant Examiner*—John P. Sheehan
*Attorney, Agent, or Firm*—Seidel, Gonda, Goldhammer & Panitch

[57] ABSTRACT

Ferromagnetic metal particles of high quality are produced by a process which comprises heat-treating starting material particles selected from the group consisting of the particles of ferromagnetic metals, ferromagnetic alloys, and oxides and hydroxides of ferromagnetic metals, in a reducing atmosphere at a temperature required for converting the material particles into ferromagnetic metal particles of improved magnetic properties. Electrostatic charges are imparted to the material particles during the heat treatment, whereby aggregation of material particles is hindered during the treatment.

6 Claims, 1 Drawing Figure

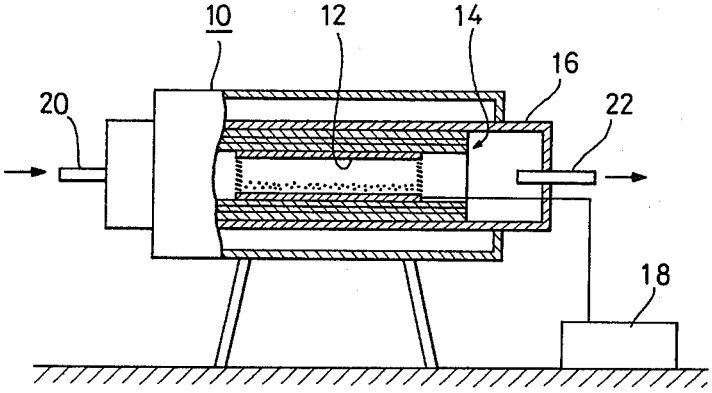
10
12
14
16
20
22
18

PROCESS FOR PRODUCING FERRO-MAGNETIC METAL PARTICLES

BACKGROUND OF THE INVENTION

This invention relates to a process for producing ferromagnetic metal particles, and more specifically to a process for heat-treating starting ferromagnetic particles or precursors thereof to convert the same into ferromagnetic powder of improved magnetic properties.

The present invention contemplates the treatment of either ferromagnetic metal particles or precursors thereof. The metal particles to be treated are of a ferromagnetic metal or alloy powder obtained by a wet reduction technique. The precursors may be an oxide or oxides or a hydroxide or hydroxides of a ferromagnetic metal or metals. Useful precursors include the oxides and hydroxides of ferromagnetic metals partially reduced by a dry reduction process.

Heretofore, acicular gamma-ferric oxide has been most commonly used as ferromagnetic particles for the magnetic recording medium. In recent years, growing demand for high density recording has led to the introduction of the magnetic recording medium using gamma ferric oxide doped with cobalt oxide or employing acicular chromium dioxide or the like. However, there are still increasing requirements for recording in even higher density.

To satisfy these requirements, development of fine metal particles as ferromagnetic particles for practical applications has been eagerly called for. Generally, for the production of fine metal particles wet and dry reduction processes are in wide use.

The manufacture of magnetic metal particles by the wet process usually consists in dissolving a metal salt in water and then adding thereto a solution of a water-soluble reducing agent in a magnetic field. The ferromagnetic particles thus obtained are fine enough to give a magnetic recording medium with a good squareness ratio. However, the product tends to have a disadvantage of low remanent magnetization, because the particles, synthesized in water, are sometimes partially converted into an oxide or hydroxide and, where sodium borohydride is employed as the water-soluble reducing agent, the magnetic powder can be contaminated with the boron compound.

A way of eliminating this disadvantage is to heat-treat the magnetic powder in an atmosphere of a reducing gas and thereby increase the remanence.

However, the magnetic powder so obtained in the form of super fines often undergoes aggregation of the particles during the heat treament. If the heat-treating temperature is lowered to avoid this danger, adequate residual magnetization will not result.

In the process of heat treatment, the reaction temperature must understandably be high enough to increase the residual magnetization and enhance the reaction efficiency. The high temperature, however, causes aggregation of the material particles, unfavorably affecting the magnetic properties of the powder and therefore the electromagnetic conversion characteristic of the resulting magnetic recording medium.

On the other hand, for the dry-process manufacture of fine metal particles, reduction with heat of an oxide of a metal, such as cobalt or nickel, or of a metal salt of an organic acid in a reducing gas atmosphere is commonly in practice. The largest obstacle in the way of commercial acceptance of the dry reduction process is the deterioration of the magnetic properties of the product with a rise in the efficiency of heating reduction and also due to the aggregation of material particles during the reduction reaction. The higher the temperature for the heating-reduction treatment, the greater the reaction rate and the productivity, with improved remanent magnetization and other magnetic properties. At the same time, the elevated temperature is apt to entail the danger of particle aggregation, which in turn will deteriorate the magnetic properties of the product.

BRIEF SUMMARY OF THE INVENTION

In an effort to overcome the foregoing difficulties we have made intensive investigations. As a result, it has now been found that the particles can be prevented from contacting one another, and hence their aggregation can be hindered, by electrostatically charging the particles and thereby taking advantage of the repulsive force that acts to separate the particles having like charges.

Thus, it is an object of the present invention to provide a process for heat-treating ferromagnetic particles or precursor particles, whereby ferromagnetic particle products having quite excellent magnetic properties can be obtained without the possibility of the particles aggregating in the course of treatment under high-temperature conditions.

Another object of the invention is to provide a process for producing magnetic metal particles, characterized in that the particles prepared by the wet reduction process is electrostatically charged during the course of a heat treatment, whereby magnetic metal particles with very excellent magnetic properties can be obtained without the danger of aggregation under high-temperature conditions.

In this aspect of the invention, it is only necessary to electrostatically charge the magnetic metal particles obtained by the wet process, during the treatment with the application of heat in a non-oxidizing vapor atmosphere. Because the repulsion tending to separate the bodies having like electric charges keeps the particles apart, aggregation of the particles is suppressed. The reduction reaction, which can use high temperature conditions, proceeds efficiently and yields a product with increased coercive force, remanent magnetization, and squareness ratio. The magnetic recording medium made of the product possesses an excellent electromagnetic conversion characteristic.

Yet another object of the invention is to provide a process for producing magnetic metal particles, characterized in that, in the course of reduction of the particles of a metal compound in a reducing vapor atmosphere, such as of a metal oxide or hydroxide, to obtain the objective particles, the compound particles are electrostatically charged during the reduction reaction, whereby magnetic metal particles having excellent magnetic properties can be obtained without any aggregation of the material particles under high-temperature conditions.

In this aspect of the invention, mere electrostatic charging of the metal oxide, hydroxide, or other metal compound particles is necesssary at the time of reduction with heat in a vapor phase. The resulting repulsive force, tending to keep the particles having like electric charges out of contact from one another, precludes the aggregation of material particles. Moreover, the reduction reaction that can be effected under high-temperature conditions proceeds with good efficiency. The product attains improved coercive force, remanent magnetization, and squareness ratio, and the magnetic recording medium made of the product exhibits an excellent electromagnetic conversion characteristic.

BRIEF EXPLANATION OF THE DRAWING

The single drawing illustrates one example of a system which is utilized in performing the process in accordance with the present invention.

DETAILED DESCRIPTION OF THE INVENTION

The metal or alloy particles which can be treated under the invention include iron particles and iron-based ferromagnetic particles, such as Co-, Ni-, and Co-Ni-containing iron particles.

The precursors which can be treated under the invention include one or more of iron oxide, cobalt oxide, nickel oxide, and Co-, Ni-, and Co-Ni-containing iron oxides. They also include one or more of iron hydroxide, cobalt hydroxide, nickel hydroxide, and Co-, Ni-, and Co-Ni-containing iron hydroxides. Further, among the useful precursors are the above-mentioned oxides and hydroxides that have been partially reduced by the dry reduction process.

For the reducing atmosphere to be used in the present invention, CO, $H_2$, or other reducing gas may be selected, the $H_2$ gas being preferable. Especially where precursor particles are to be treated, either $H_2$ or CO gas should be employed. For the treatment of metal or alloy particles, $N_2$ may be used aside from those mentioned above.

The temperature and time for the heat treatment depend on the kind of the starting material to be employed, but may be easily chosen by one skilled in the art. For example, a temperature between 300° and 650° C. and a period of time ranging from 10 minutes to 6 hours may be used.

The key point of the present invention is that electrostatic charges are imparted to the particles of the starting material (metal or precursor particles) during the heat treatment.

The electrostatic charges may be imparted by any conventional means. For example, the charging can be done by applying a high-voltage electric potential to material particles by a Van de Graaff generator. Although the measurement of charges is not easy, charges in the range of 5–40 KV as generated by the equipment may be used. Experiments indicate that the aggregation-preventive effect is produced by charging up to a certain level; charging to excess will not enhance the effect accordingly.

The accompanying drawing is a schematic illustration of an apparatus used for practicing the process of the invention. A cylindrical container 12 of stainless steel, both open ends of which are covered by fine-mesh screens, is held in contact with a core tube 16 of an electric oven 10 through insulation 14 so that the container can serve as a capacitor. The cylindrical container 12 is electrically connected to a Van de Graaff generator 18 for electrostatic charging. A reducing gas is flown through the core tube 16 via an inlet tube 20 and an outlet tube 22.

The invention is illustrated by the following Examples and Comparative Examples.

EXAMPLE 1

Twenty grams of thoroughly dried iron particles, prepared by the wet reduction process, was placed in the cylindrical container of stainless steel, both ends of which had been covered with fine-mesh screens, and was heated to 380° C. by the tubular electric oven. The cylindrical container was electrostatically charged to 30 KV by the Van de Graaff generator, and the material powder was heat-treated in an atmosphere of fresh hydrogen gas for one hour. The electric potential of approximately 30 KV was maintained throughout the reaction period. Following the conclusion of the heat treatment, the polarities of the generator were exchanged and the static charge was gradually removed until the potential became zero. The product was taken out of the vessel, and its magnetic properties were evaluated by means of an oscillation type magnetometer. The results are given in Table 1, together with the results of an experiment (Comparative Example 1) in which the invention was not reduced into practice but the same starting material was simply heat-treated at 380° C. for one hour with supply of fresh hydrogen gas.

TABLE 1

| | Coercive force (Oe) | Remanent magnetization (emu/g) | Squareness ratio |
|---|---|---|---|
| Example 1 | 1210 | 68.0 | 0.53 |
| Comp. Ex. 1 | 120 | 20.8 | 0.14 |
| Before treatment | 1050 | 60.0 | 0.499 |

As can be seen from the table, the properties in Comparative Example 1 are low because of material particle aggregation, whereas Example 1 show increases in all items of coercive force, remanent magnetization, and squareness ratio.

EXAMPLE 2

Thirty grams of thoroughly dried $\gamma$-$Fe_2O_3$ was placed in the cylindrical container of stainless steel, both ends of which had been converted with fine-mesh screens, and was heated to 450° C. by the tubular electric oven. The cylindrical container was electrostatically charged to 30 KV by the Van de Graaff generator, and the material powder was subjected to a reduction reaction with supply of fresh hydrogen gas for two hours. Throughout the reaction period the electric potential was kept at approximately 30 KV. After the reaction the polarities of the generator were reversed to remove the static charge gradually until the potential was reduced to zero. The product was taken out of the vessel, and its magnetic properties were examined by means of an oscillation type magnetometer. In Comparative Example, the same starting material was merely reduced to 450° C. for two hours in the atmosphere of fresh hydrogen gas, without the electrostatic charging as under the invention. The both results are shown in Table 2.

TABLE 2

| | Coercive force (Oe) | Remanent magnetization (emu/g) | Squareness ratio |
|---|---|---|---|
| Example 2 | 1220 | 72.3 | 0.54 |
| Comp. Ex. 2 | 760 | 21.4 | 0.31 |

It will be appreciated that the coercive force, remanent magnetization, and squareness ratio are all improved in Example 2, in contrast to Comparative Example 2 where aggregation of particles resulted in much lower properties.

While the present invention has been described in detail in conjunction with preferred embodiments thereof, it is to be understood, of course, that the invention is not limited thereto but numerous modifications and alterations are possible without departing from the spirit of the invention. For example, the conditions used in the embodiments, i.e., Temperature range: 300°-650° C.
Reaction time: 13 min.-6 hrs.
Amount of material: 0.5-2000 g
Charging voltage: 5-45 KV
Reduction gas: $H_2$, CO, $N_2$, etc.
Reduction gas flow rate: 1-30 l/min are applicable only to those embodiments and may be varied otherwise according to the scale of process operation.

What we claim is:

1. A process for producing ferromagnetic metal particles, which comprises heating starting material particles selected from the group consisting of the particles of oxides and hydroxides of ferromagnetic metals, in a reducing atmosphere at a temperature required for converting said particles into ferromagnetic metal particles of improved magnetic properties, characterized in that electrostatic charges are imparted to the material particles during said heat treatment, whereby aggregation of material particles is hindered during said treatment.

2. A process for producing ferromagnetic metal particles according to claim 1, wherein said reducing atmosphere is either $H_2$ or CO.

3. A process for producing ferromagnetic metal particles according to claim 1 or 2, wherein said material particles are particles of one or more oxides or complex oxides of Ni, Co, and Fe, or one or more hydroxides or complex hydroxides of Ni, Co, and Fe.

4. A process for heat-treating ferromagnetic metal particles, which comprises heating starting material particles selected from the group consisting of the particles of ferromagnetic metals and ferromagnetic alloys in a non-oxidizing atmosphere at a temperature required for converting said material particles into ferromagnetic metal particles of improved magnetic properties, characterized in that electrostatic charges are imparted to the material particles during said heat treatment, whereby aggregation of material particles is hindered during said treatment.

5. A process for heat-treating ferromagnetic metal particles according to claim 4, wherein said non-oxidizing atmosphere is either $H_2$, CO or $N_2$.

6. A process for heat-treating ferromagnetic metal particles according to claim 4 or 5, wherein said material particles are particles of one or more metals or Ni, Co, and Fe, or alloys of Fe-Ni and Fe-Co.

* * * * *